US012247809B2

(12) United States Patent
Hughes

(10) Patent No.: US 12,247,809 B2
(45) Date of Patent: Mar. 11, 2025

(54) ARCHERY BOW SIGHT WITH SNAP-IN LEVEL

(71) Applicant: Bear Archery, Inc., Evansville, IN (US)

(72) Inventor: Andrew Hughes, Evansville, IN (US)

(73) Assignee: Bear Archery, Inc., Evansville, IN (US)

( * ) Notice: Subject to any disclaimer, the term of this patent is extended or adjusted under 35 U.S.C. 154(b) by 519 days.

(21) Appl. No.: 17/734,394

(22) Filed: May 2, 2022

(65) Prior Publication Data

US 2023/0349669 A1 Nov. 2, 2023

(51) Int. Cl.
*F41G 1/467* (2006.01)
*F41G 1/44* (2006.01)

(52) U.S. Cl.
CPC ..... *F41G 1/44* (2013.01); *F41G 1/467* (2013.01)

(58) Field of Classification Search
CPC ..... F41G 1/44; F41G 1/467
USPC ..... 33/265
See application file for complete search history.

(56) References Cited

U.S. PATENT DOCUMENTS 1,940,808 A * 12/1933 Linsert ..... F41G 1/48 33/372
5,303,479 A * 4/1994 Rudovsky ..... F41G 1/467 124/87
5,630,279 A * 5/1997 Slates ..... F41G 1/467 124/87
6,701,632 B2 * 3/2004 Henry ..... F41G 1/467 124/87
7,603,784 B2 10/2009 Erhard
8,161,656 B1 * 4/2012 Ellgass ..... F41G 1/467 124/87
8,176,644 B1 5/2012 Summers et al.
8,245,409 B2 * 8/2012 Varner ..... F41G 1/467 124/87
8,677,637 B2 * 3/2014 Willis ..... F41G 1/467 124/87
8,713,807 B2 * 5/2014 LoRocco ..... F41G 1/345 362/110
8,819,985 B1 * 9/2014 McCoy ..... F41G 11/001 42/111
8,869,784 B2 * 10/2014 LoRocco ..... F41G 1/467 124/87
9,103,632 B1 * 8/2015 Larson ..... F41G 1/467
9,285,188 B1 3/2016 LoRocco et al.
9,909,839 B1 * 3/2018 Hamm ..... F41G 1/41
10,036,612 B2 * 7/2018 Hamm ..... F41G 1/467
10,228,218 B2 3/2019 Mason et al.
10,545,009 B1 * 1/2020 Bartak ..... G01C 9/24
10,663,257 B2 * 5/2020 Dale ..... F41G 1/467
10,907,933 B1 * 2/2021 Hamm ..... F41G 1/467
11,519,694 B1 * 12/2022 Hamm ..... F41G 1/467
(Continued)

*Primary Examiner* — George B Bennett
(74) *Attorney, Agent, or Firm* — Woodard, Emhardt, Henry, Reeves & Wagner, LLP

(57) ABSTRACT

Aspects of the present disclosure deal with archery sights mounted and/or mountable on an archery bow. The sight incorporates a sight hood with a removable sight level. The sight level is configured to snap-fit into one or more apertures defined the sight hood. To configure the sight for left- or right-handed use, an archer rotates the sight hood to the desired orientation and secures the sight level within the preferred aperture.

17 Claims, 12 Drawing Sheets

(56) References Cited

U.S. PATENT DOCUMENTS

| | | | | |
|---|---|---|---|---|
| 11,754,370 | B2 * | 9/2023 | Mogle | F41G 1/44<br>124/87 |
| 11,796,285 | B1 * | 10/2023 | Major | F41G 1/467 |
| 2005/0138824 | A1 * | 6/2005 | Afshari | F41G 1/467<br>33/265 |
| 2021/0325148 | A1 * | 10/2021 | Jones | F41G 1/467 |
| 2021/0372737 | A1 * | 12/2021 | Masarik | G02B 26/0816 |
| 2024/0240916 | A1 * | 7/2024 | Forestieri, Sr. | F41G 1/467 |

* cited by examiner

ARCHERY BOW SIGHT WITH SNAP-IN LEVEL

FIELD OF THE DISCLOSURE

Aspects of the present invention deal with archery bows, and in particular deal with accessories such as sights usable with archery bows.

BACKGROUND

A bow sight can be used to assist an archer in aiming a bow. A typical bow sight includes a sight housing and/or hood secured to a frame and/or riser of a bow by one or more brackets. The sight housing often defines a viewing opening (i.e., a sight window) through which an archer can frame a target. The bow sight also typically includes at least one sighting member, such as a pin, that projects into the viewing opening. The sighting member defines and supports a sight point. The sight point is the point the archer aligns with the target during aiming. In use, the archer draws the drawstring of the bow and adjusts the position of the bow so that the intended target is visible through the viewing opening. While continuing to peer through the viewing opening with the bowstring drawn, the archer adjusts the position of the bow so that the sight point aligns with the intended target from the archer's eye. Once the sight point is aligned with the intended target, the archer releases the bowstring to shoot the arrow.

Archery sights typically come in either a left handed or a right-handed model. For example, a right-handed archer typically must use a right-handed archery sight with a right-handed bow. As should be appreciated, typical right-handed archery sights are generally unable to be effectively used on left-handed archery bows. In one example, a sight level of a right-handed sight is located along a lower edge of the sight hood when mounted to a right-handed bow, but if mounted to a left-handed bow the sight level is located along an upper edge of the sight hood. Thus, an archer is unable to utilize a right-handed sight effectively on a left-handed bow and vice versa.

SUMMARY

Embodiments of the present disclosure include sights and sight levels for archery bows. A sight hood and/or scope of an archery sight may include a bubble level. The sight hood defines one or more apertures configured to retain a bubble level in place and orientation via a snap-fit. In one example, the sight hood includes two (2) apertures located along the upper and lower edges of the sight hood.

The apertures enable a user to selectively place a sight level in a desired configuration. For example, a user may snap the level into a first aperture of the hood, which is along the lower edge when in the right-hand configuration. In that position the second aperture is along the upper edge. If the hood is rotated 180 degrees to a left-hand configuration, the second aperture is then oriented along the lower edge. A user may snap the level into the second aperture so it is along the lower edge in a left-hand configuration. As should be appreciated, the modularity of the sight hood and level enables a single bow sight to be used by left- or right-handed archers without needing to purchase separate right- and left-handed sights.

In a representative embodiment, a sight for an archery bow includes a mounting bracket configured to mount to an archery bow and a sight hood removably mounted to the mounting bracket. The sight hood defines at least one aperture. A sight level is mounted within the sight hood in the at least one aperture. The sight level is selectively retained within the at least one aperture via a snap-fit connection between the sight level and the aperture.

In an alternate embodiment, a sight for an archery bow includes a mounting bracket configured to mount to an archery bow, a sight hood removably mounted to the mounting bracket, and a sight level. The sight hood defines a pair of opposing apertures. The sight level is selectively positionable in either of the pair of apertures, and the sight level is removably held within the selected aperture via a snap-fit connection between the sight level and the selected aperture.

In a further embodiment, a sight for an archery bow includes a mounting bracket configured to mount to an archery bow, a sight hood removably mounted to the mounting bracket, and a sight level. The sight hood defines a pair of opposing apertures. The sight is configured for a right-hand configuration or a left-hand configuration by orienting the sight hood in a desired orientation and placing the sight level in the aperture oriented along a lower edge of the sight hood in the desired orientation. The sight level is selectively held within the aperture via a snap-fit connection between the sight level and the aperture.

Other objects and attendant advantages will be readily appreciated, as the same become better understood by reference to the following detailed description when considered in connection with the accompanying drawings.

DESCRIPTION OF THE ILLUSTRATED EMBODIMENTS

For the purposes of promoting an understanding of the principles of the disclosure, reference will now be made to the embodiments illustrated and specific language will be used to describe the same. It will nevertheless be understood that no limitation of the scope of the disclosure is thereby intended, such alterations, modifications, and further applications of the principles being contemplated as would normally occur to one skilled in the art to which the disclosure relates.

Figure 1:
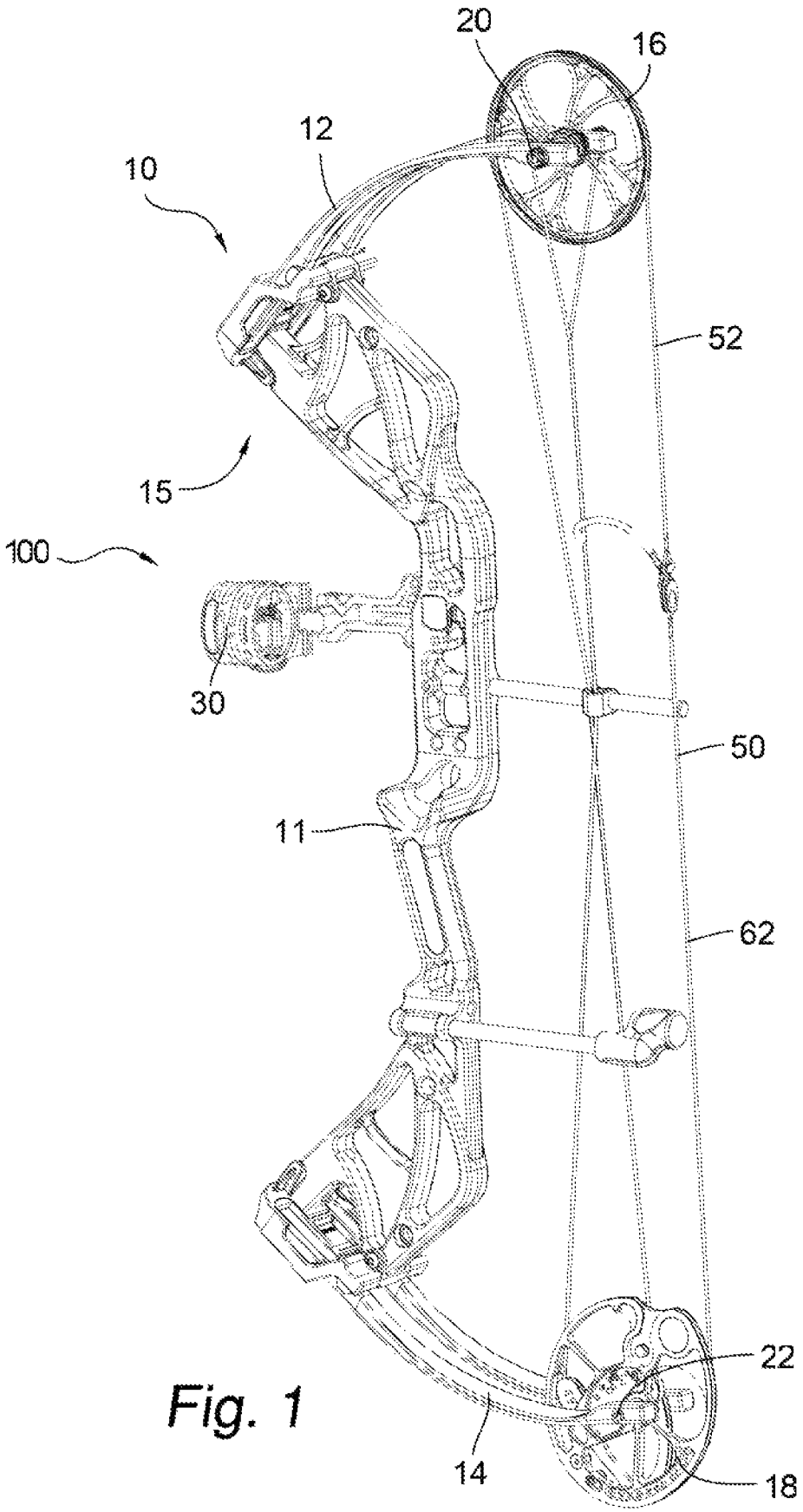
FIG. 1 is a perspective view of a representative embodiment of an archery bow with an archery sight according to an embodiment of the present disclosure.

FIG. 1 illustrates a representative example of an archery bow 10 incorporating an archery sight 100 according to the present disclosure. Bow 10 includes a riser 11 with a handle, an upper limb or pair of limbs 12 and a lower limb or pair of limbs 14. In the embodiment shown, upper and lower limbs are formed of parallel and symmetric limbs sometimes called a quad limb arrangement. Alternately, a single piece limb can have a notch or slot area removed to allow a rotational element to be mounted to the limb tips. In the single cam example illustrated, rotational members such as idler wheel 16 and eccentric cam 18 are supported at the limb tip sections for rotary movement about axles 20 and 22. An upper pulley axle 20 is carried between the outer limb tip portions of upper limb 12. A lower pulley axle 22 is carried between the outer limb tip portions of lower limb 14.

The portion of the cable which defines the bowstring 50 includes an upper portion 52 and a lower portion 62 which are fed-out from idler wheel 16 and cam 18 when the bow is drawn. The upper portion 52 may be part of a longer cable which has a medial portion mounted around idler wheel 16 with the ends mounted to cam 18. The non-bowstring portion of the cable extending from wheel 16 to cam 18 can be referred to as the return cable portion. Additionally, a y-yoke anchor cable has a lower end mounted to cam 18 which extends to two upper ends mounted adjacent opposing ends of axle 20. Each cable has a thickness and a round cross-section defining a circumference. From the perspective of the archer, the bowstring is considered rearward relative to the riser which defines forward.

When the bowstring 50 is drawn, it causes idler wheel 16 and cam 18 at each end of the bow to rotate, feeding out cable and bending limbs 12 and 14 inward, causing energy to be stored therein. When the bowstring 50 is released with an arrow engaged to the bowstring, the limbs 12 and 14 return to their rest position, causing idler wheel 16 and cam 18 to rotate in the opposite direction, to take up the bowstring 50 and launch the arrow with an amount of energy proportional to the energy initially stored in the bow limbs. Bow 10 is described for illustration and context and is not intended to be limiting.

While not illustrated, embodiments of the present disclosure can also be used in other types of bows, for example dual cam or two cam bows, hybrid cam bows or recurve bows which are considered conventional for purposes of the present disclosure. For convenience, the combination of riser 11 and either single or quad limbs forming upper limb 12 and lower limb 14 may generally be referred to as archery bow body 15. Accordingly, it should be appreciated that the archery bow body can take on various designs in accordance with the many different types of bows with which the present disclosure can be used. Various accessories, such as arrow rests, stabilizers and quivers can be mounted to bow body 15.

Archery sight 100 is typically mounted to or formed as part of riser 11 above the arrow rest position. The archery sight 100 defines at least one aiming point 30. Commonly, archery sight 100 is used in combination with a peep sight.

Figure 2:
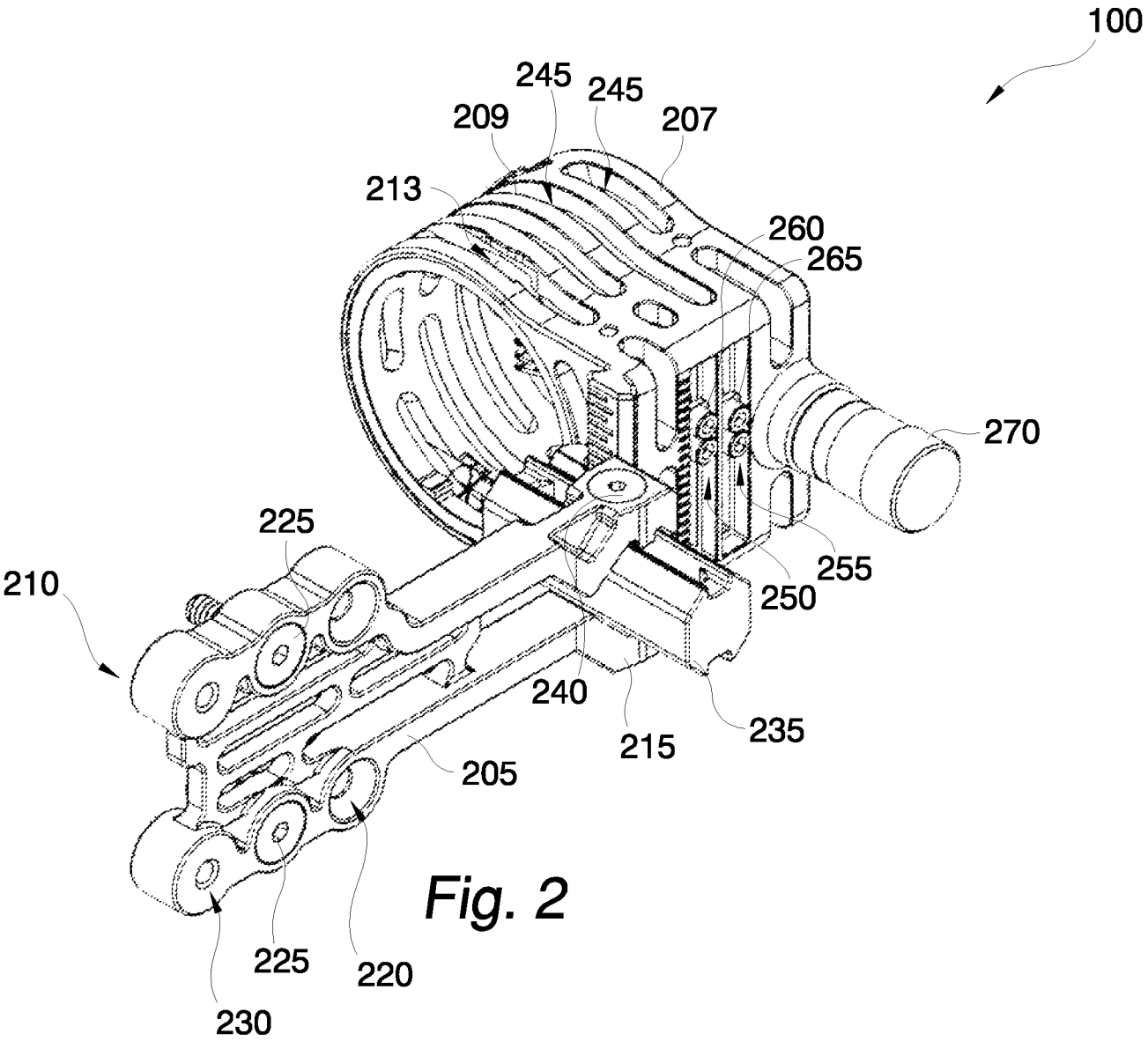
FIG. 2 is a perspective view of an archery sight according to an embodiment of the present disclosure.
Figure 3:
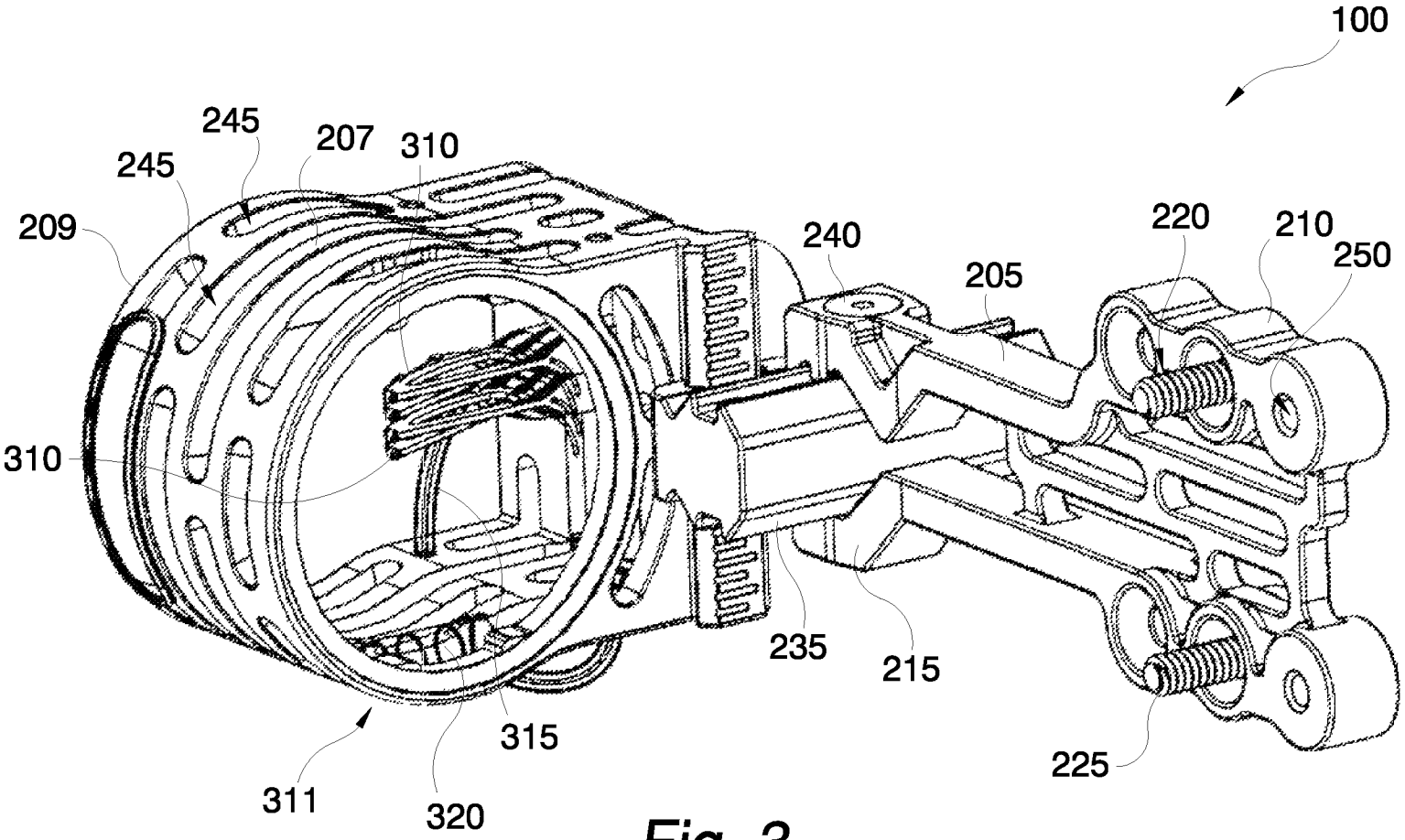
FIG. 3 is another perspective view of the archery sight of FIG. 2.
Figure 4:
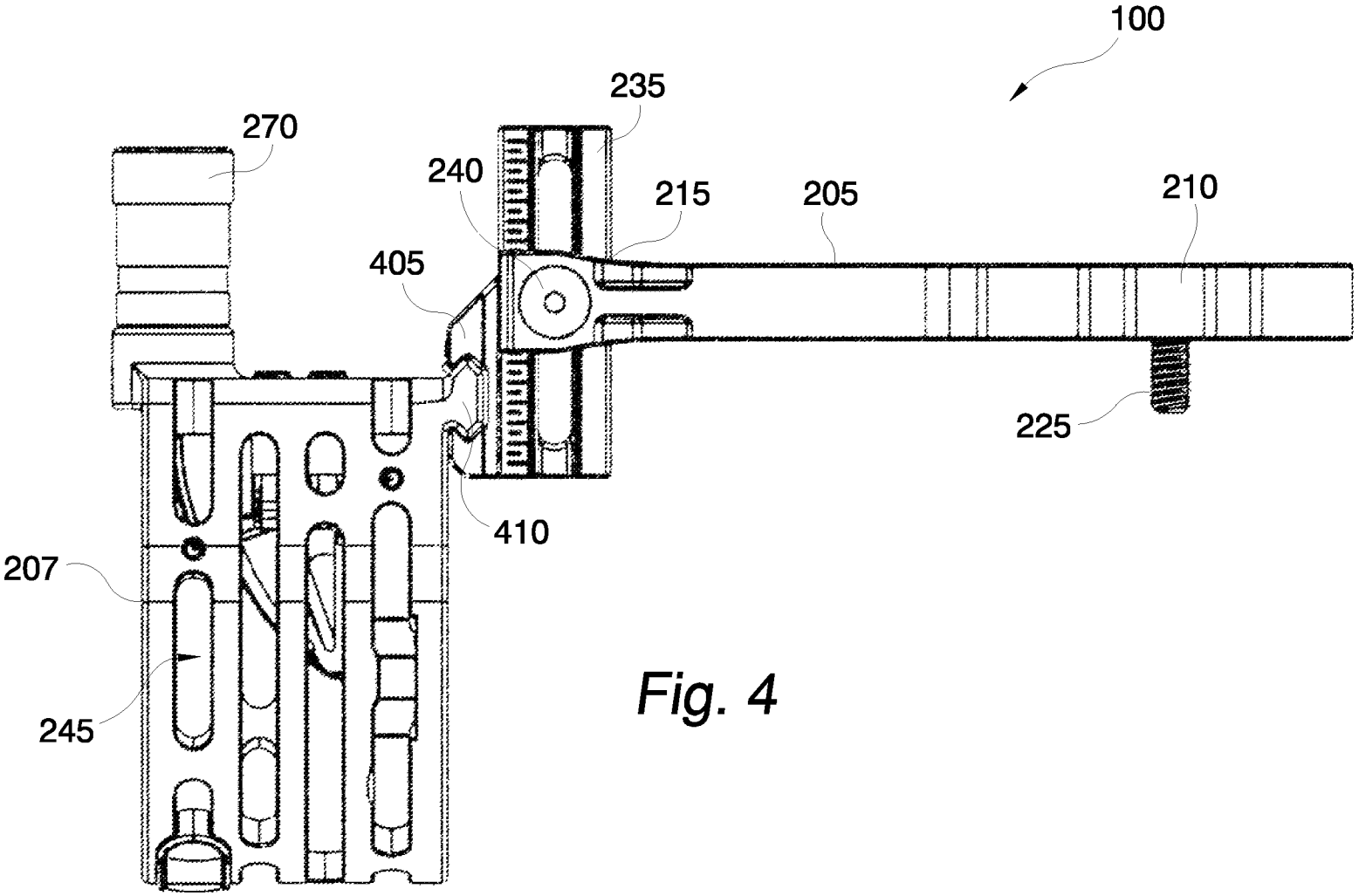
FIG. 4 is a top view of the archery sight of FIG. 2.

FIGS. 2-4 show different views of the archery sight 100. The archery sight 100 generally includes a sight level 320 (Shown in FIG. 3) mounted within a sight hood 207 via a snap-fit. The snap-fit connection of the sight level 320 enables an archer to easily remove and/or replace the sight level 320. The sight hood 207 further includes one or more apertures disposed around a circumference of the sight hood 207. For example, the sight hood 207 may include a pair of apertures located directly across from each other. Put differently, the sight hood 207 may include apertures at the twelve o'clock and the six o'clock positions. The apertures are generally configured to receive and retain the sight level 320 via a snap-fit. As should be appreciated, multiple apertures enable an archer to select and/or change the location of the sight level 320 within the sight hood 207. In one example, the sight hood 209 includes a first aperture 311 and a second aperture 213 located opposite the first aperture 311. The snap-fit sight level 320 and the apertures enable the archery sight 100 to be ambidextrous. For example, the archery sight 100 is able to be used in either a right-handed configuration or a left-handed configuration. This ambidextrous design enables archers to utilize a single archery sight regardless of the handedness of the archer.

The archery sight 100 generally includes a mounting bracket 205 and a sight hood 207 removably mounted to the mounting bracket 205. The mounting bracket 205 is configured to mount to the riser of the archery bow via a mounting portion 210. The mounting bracket 205 may be a fixed mount such that a length of the mounting bracket 205 is fixed. In another example, the mounting bracket 205 may be a dovetail mount such that a length of the mounting bracket 205 is adjustable. As should be appreciated, adjusting the length of the mounting bracket 205 enables an archer to position the archery sight 100 nearer to and/or further from the riser of the archery bow.

The mounting portion 210 generally includes one or more mounting holes 220 configured to receive one or more fasteners 225. As should be appreciated, fasteners 225 may be in the form of screws, bolts, rivets, welds, adhesive, and/or other fasteners. Located adjacent the mounting holes 220 are one or more quiver mounting holes 230.

At an end opposite the mounting portion 210, the mounting bracket 205 includes a windage clamp 215. The windage clamp 215 is configured to secure a windage bar 235 via a clamping force supplied by a fastener 240. Fastener 240 may be in the form of a screw, bolt, rivet, weld, adhesive, and/or other fastener. The windage bar 235 includes an elevation clamp 405 configured to secure an elevation bar 410 of the sight hood 207 (best shown in FIG. 4).

The sight hood 207 is removably mounted to the mounting bracket 205. The sight hood 207 is generally in the form of a hollow substantially cylindrical hood and/or housing configured to hold one or more sight pins 310. The sight pins 310 are generally mounted within the sight hood 207 via one or more first pin adjusters 260 and one or more second pin adjusters 265. The first pin adjusters 260 are generally removably mounted within a first slot 250. The second pin adjusters 265 are generally removably mounted within a second slot 255. The sight pins 310 may be adjusted vertically by an archer when tuning and/or sighting in the archery bow. The sight pins 310 may work with fiber optic strands 315. The fiber optic strands 315 are configured to absorb light and illuminate the sight pins 310 to assist and archer in aiming the archery bow. In some cases, the sight hood 207 may include a removable sight light 270.

Mounted within a body 209 of the sight hood 207 is generally the sight level 320. The sight level 320 assists an archer with leveling the archery sight 100 and/or archery bow during a shot. Without the sight level 320 the archer could potentially impart torque into the shot and affect the shot placement. However, with the sight level 320, the archer is able to monitor the torque applied and maximize accuracy.

The sight level 320 is generally in the form of a bubble level. Most commonly, the sight level 320 is positioned at a bottom edge of the sight hood 207. As disclosed herein, the sight level 320 is secured within the body 209 of the sight hood 207 via a snap-fit. Snap-fit generally refers to a type of attachment including at least two components, with at least one of which is flexible, that are interlocked with one another by pushing the components together. A snap-fit connection may refer to just one of the components, such as either the protruding or mating component, and/or both of the components when joined together. Typically, but not always, the snap-fit includes a protrusion of one component that is deflected briefly during the joining operation. After the components are joined, the flexible snap-fit parts rebounds to hold the parts together. The force required to separate the components can vary depending on the design. By way of non-limiting examples, the flexible components are made of a semiflexible material such as plastic, metal, rubber, and/or carbon fiber composite materials. In one example of a snap-fit, protruding edges of one component are pushed away from the target insertion area, and the other component then slides in between the protruding edges until a desired distance is reached. Once the desired distance is reached, the edges are then released and return to close to their original position such that the component is held in place.

As can be seen in FIGS. 9-12, the sight level 320 is held within the selected aperture via the snap fit. The first aperture 311 and the second aperture 213 are formed as cavities and/or receptacles of the sight hood 207, for instance within one or more cutouts 245 between a pair of ribs 930. The ribs 930 include a set of resilient members in the form of a pair of first prongs 915 at one end and a pair of second prongs 920 at an opposing end configured to secure the sight level 320 therebetween. The prongs of the sight hood 207 are generally somewhat flexible and/or resilient such that an archer can manually snap the sight level 320 into the first aperture 311. For example, the sight hood 207 may be made of plastic and/or a polymeric material. In another example, the sight hood 207 may be made from a metallic material. In some cases, the sight hood 207 may include a removable sight light 905.

The first prongs 915 and the second prongs 920 define an opening and/or mouth of the first aperture 311 such that once the sight level 320 is forced into the first aperture 311, the sight level 320 does not come out of the first aperture 311 without assistance from an archer. Put differently, the circumference of the sight level 320 is larger than an opening defined by the first prongs 915 and the second prongs 920. To prevent the sight level 320 from falling through the first aperture 311, the first aperture 311 includes a tongue 935. The tongue 935 is configured to serve as a base for the sight level 320 to prevent the sight level 320 from falling out of the first aperture 311. As illustrated, the sight level 320 is generally a cylindrical shape. However, in other examples, the sight level 320 may be rectangular, triangular, and/or another polygonal shape. As should be appreciated, the sight level 320 is secured via a snap-fit to enable removal and/or replacement of the sight level 320.

In another embodiment, the position of the sight level 320 within the sight hood 207 can be selected from among multiple apertures. For instance, the position of the sight level 320 may be selected based on the selected dexterity of the archery sight 100. For example, a left-handed archery sight and a right-handed archery sight may require different sight level positions.

Figure 5:
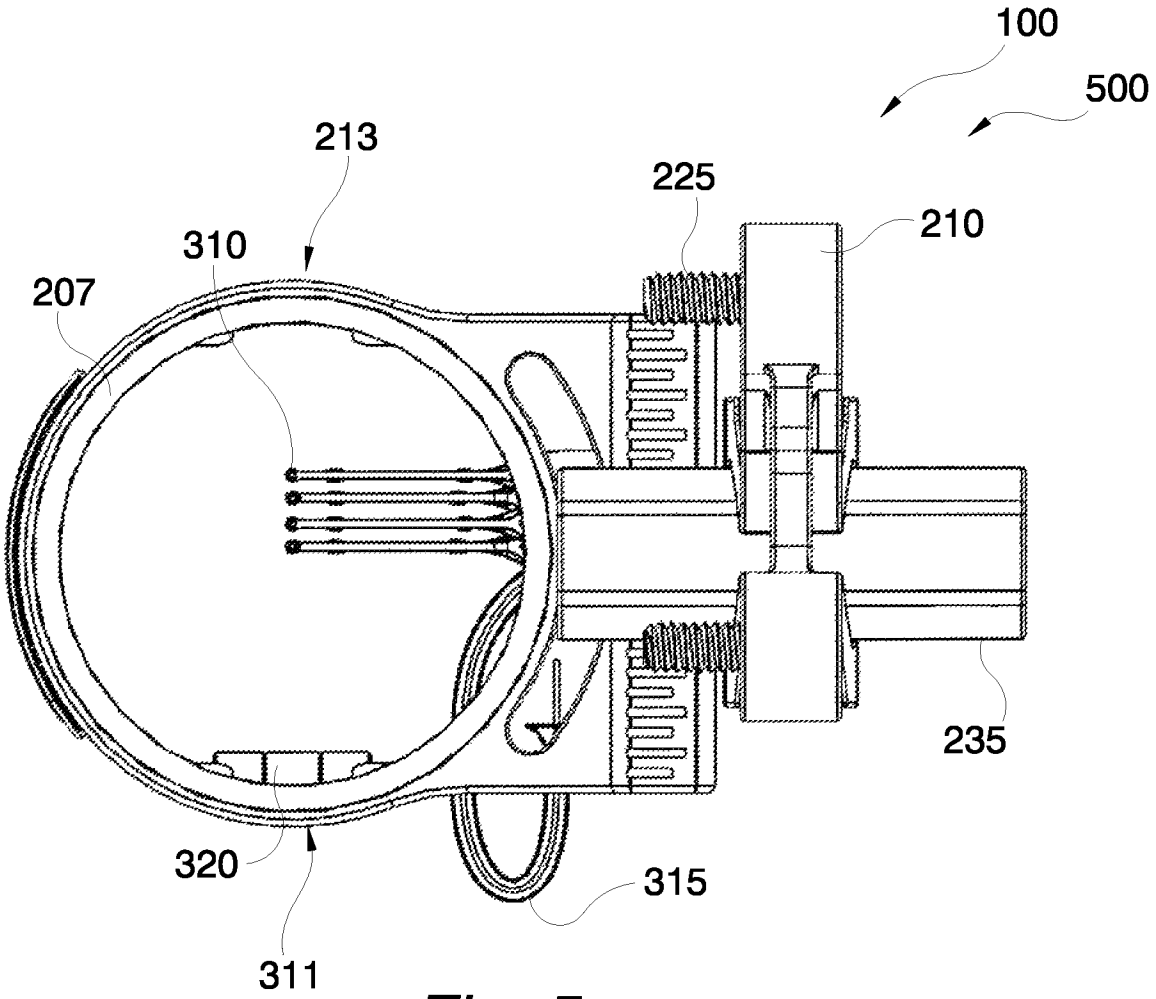
FIG. 5 is a rear view of the archery sight of FIG. 2 in a right-hand configuration.
Figure 6:
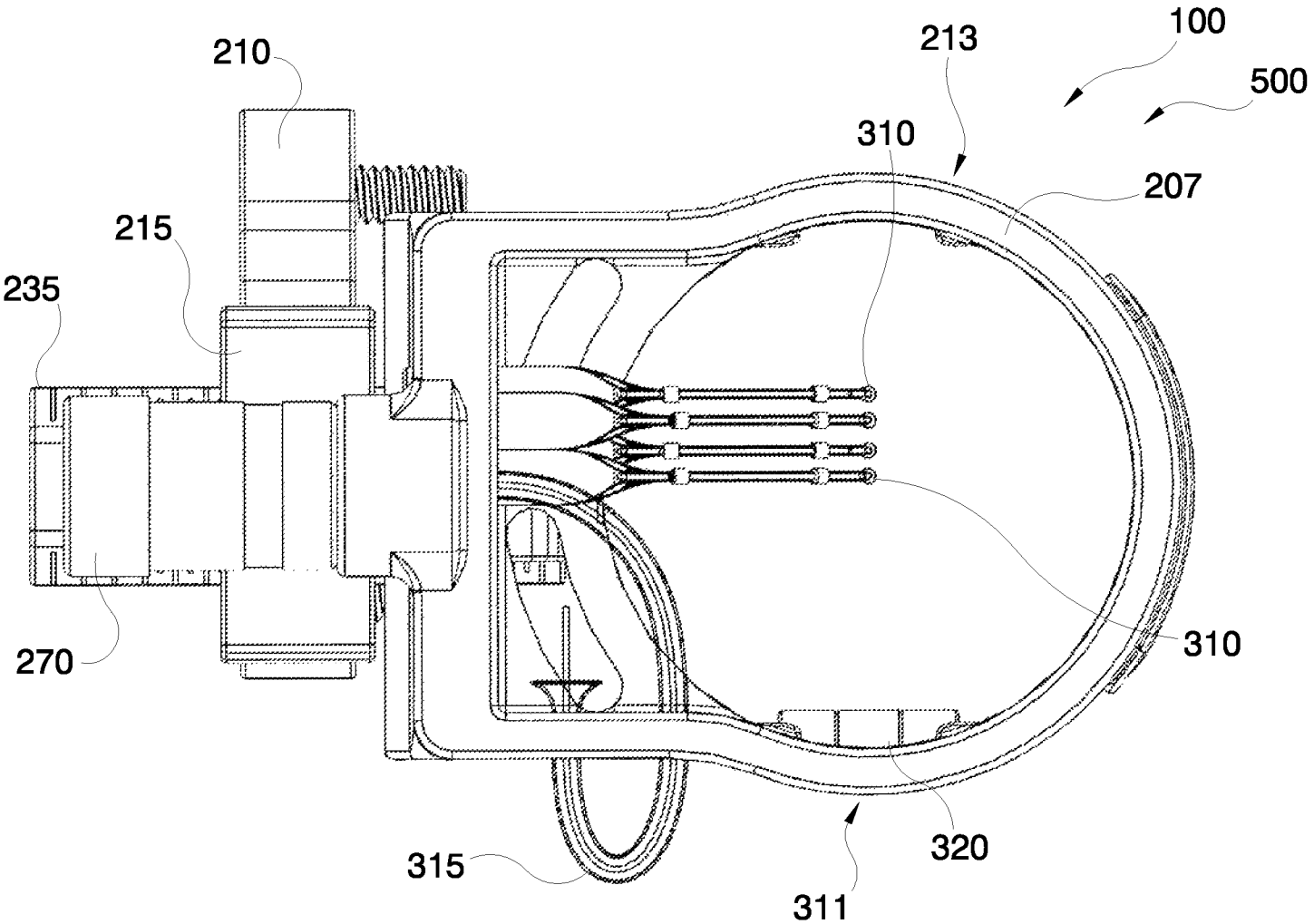
FIG. 6 is a is a front view of the archery sight of FIG. 2 in a right-hand configuration.

FIGS. 5 and 6 show examples of the archery sight 100 in a right-hand configuration 500. In the right-hand configuration 500 the sight level 320 is generally held within a first aperture 311. The first aperture 311 is defined by the body 209 and is generally positioned along a bottom edge of the sight hood 207 when in the right-hand configuration 500. The snap-fit is configured to enable an archer to remove the sight level 320 from the first aperture 311 when desired. Optionally, an archer may decide to mount the sight level 320 in the second aperture 213, at an upper edge of the sight hood 207, when in the right-hand configuration based on personal preference.

Figure 7:
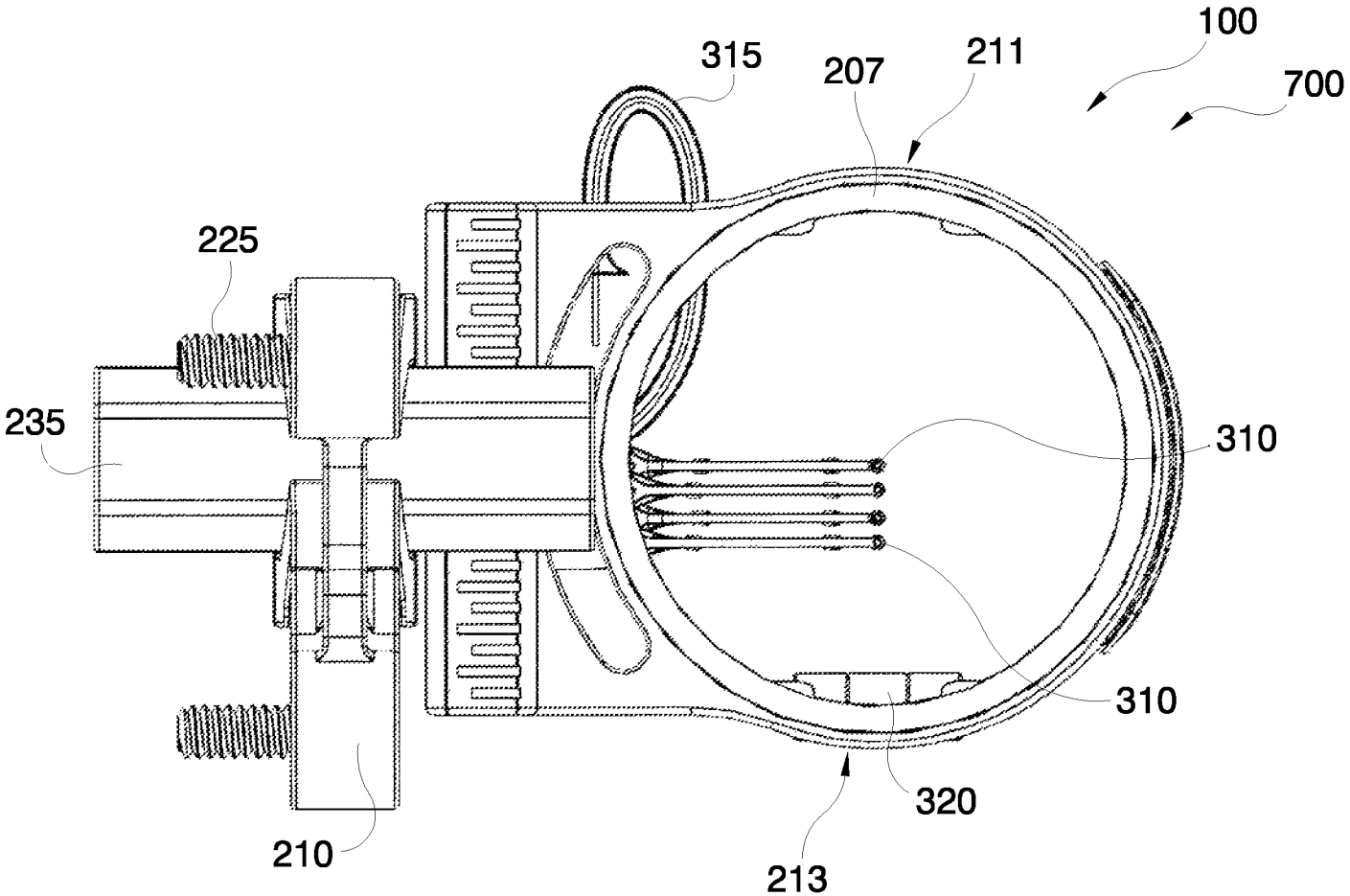
FIG. 7 is a rear view of the archery sight of FIG. 2 in a left-hand configuration.
Figure 8:
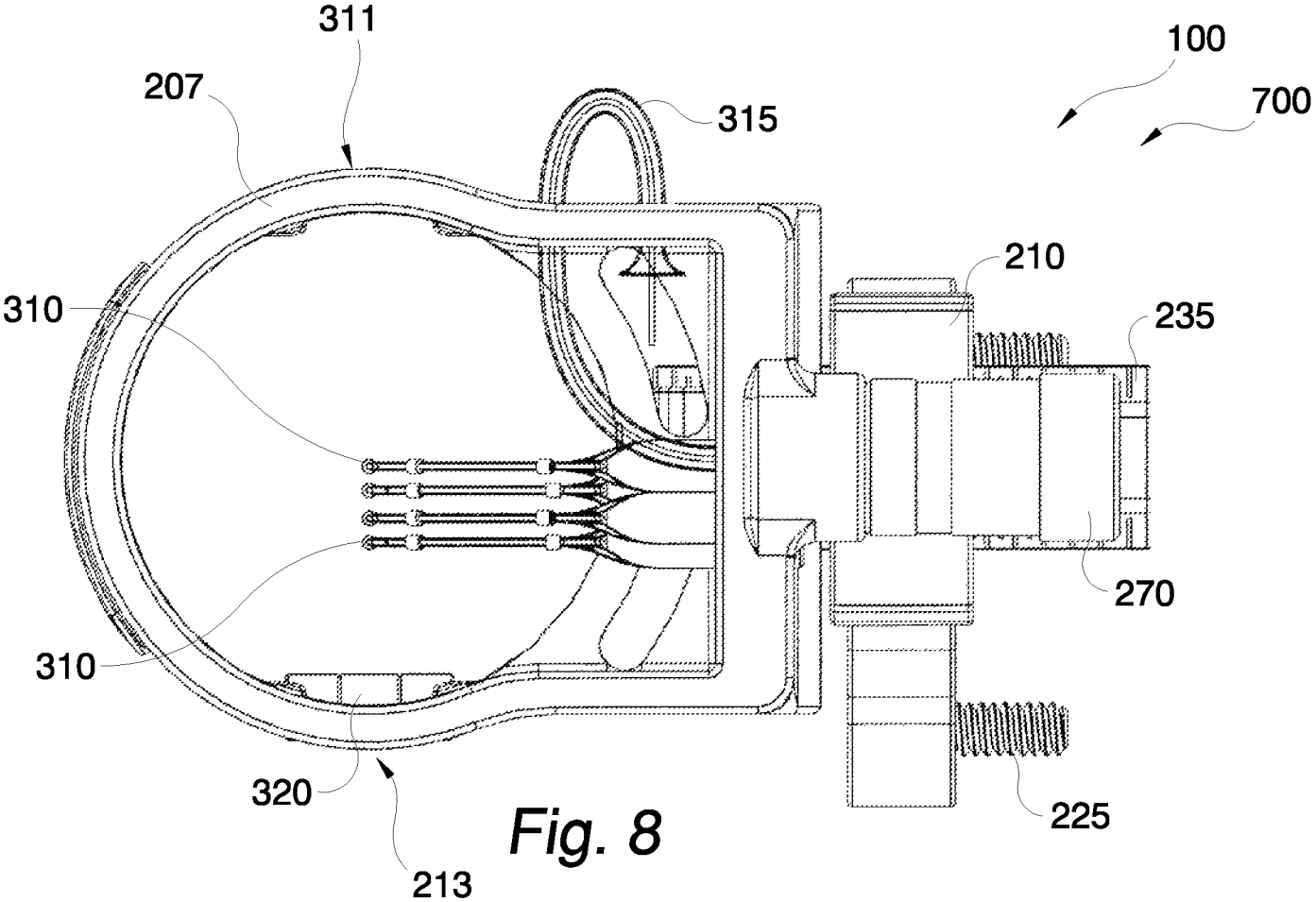
FIG. 8 is a front view of the archery sight of FIG. 2 in a left-hand configuration.
Figure 9:
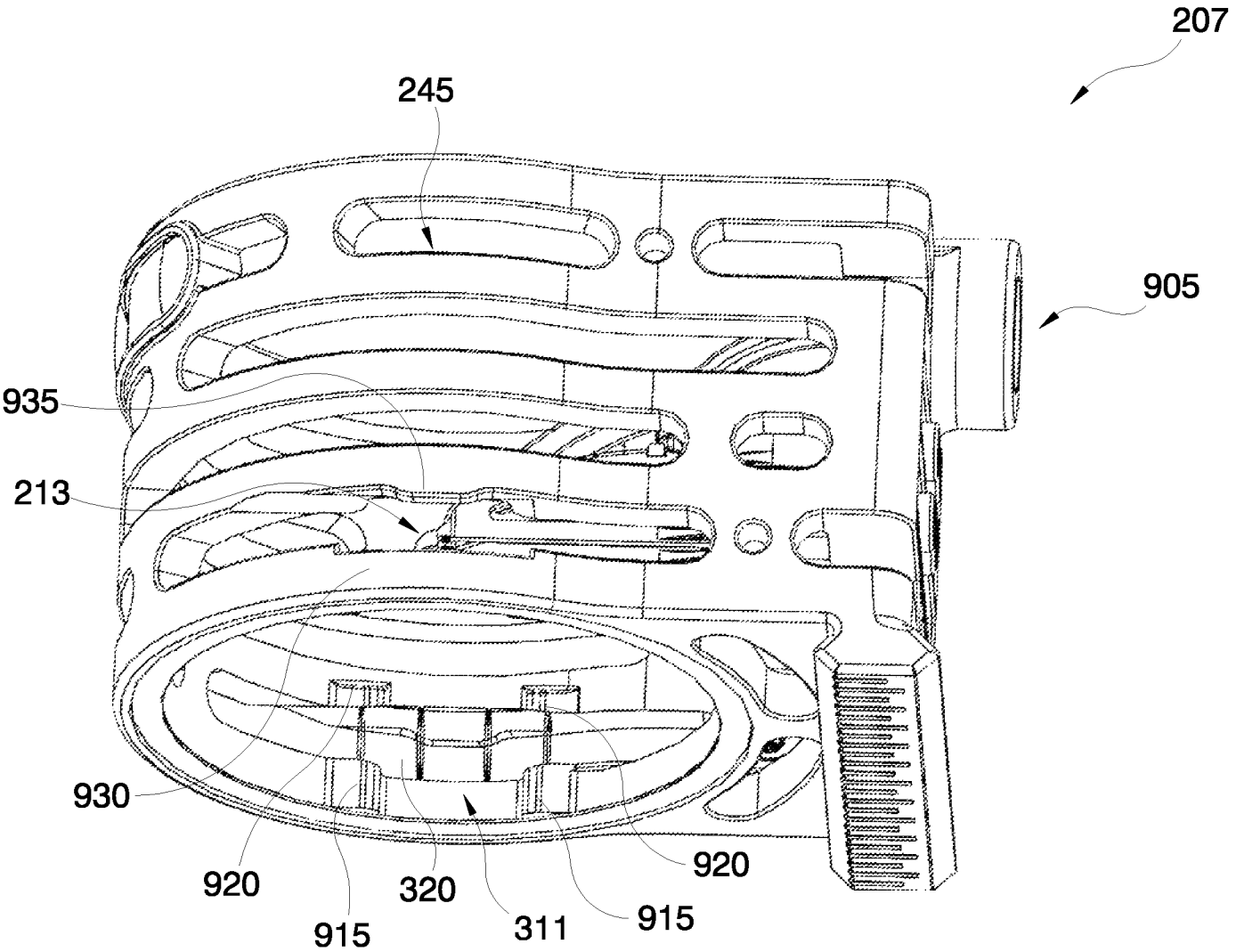
FIG. 9 is a perspective view of a sight hood according to an embodiment of the present disclosure.
Figure 10:
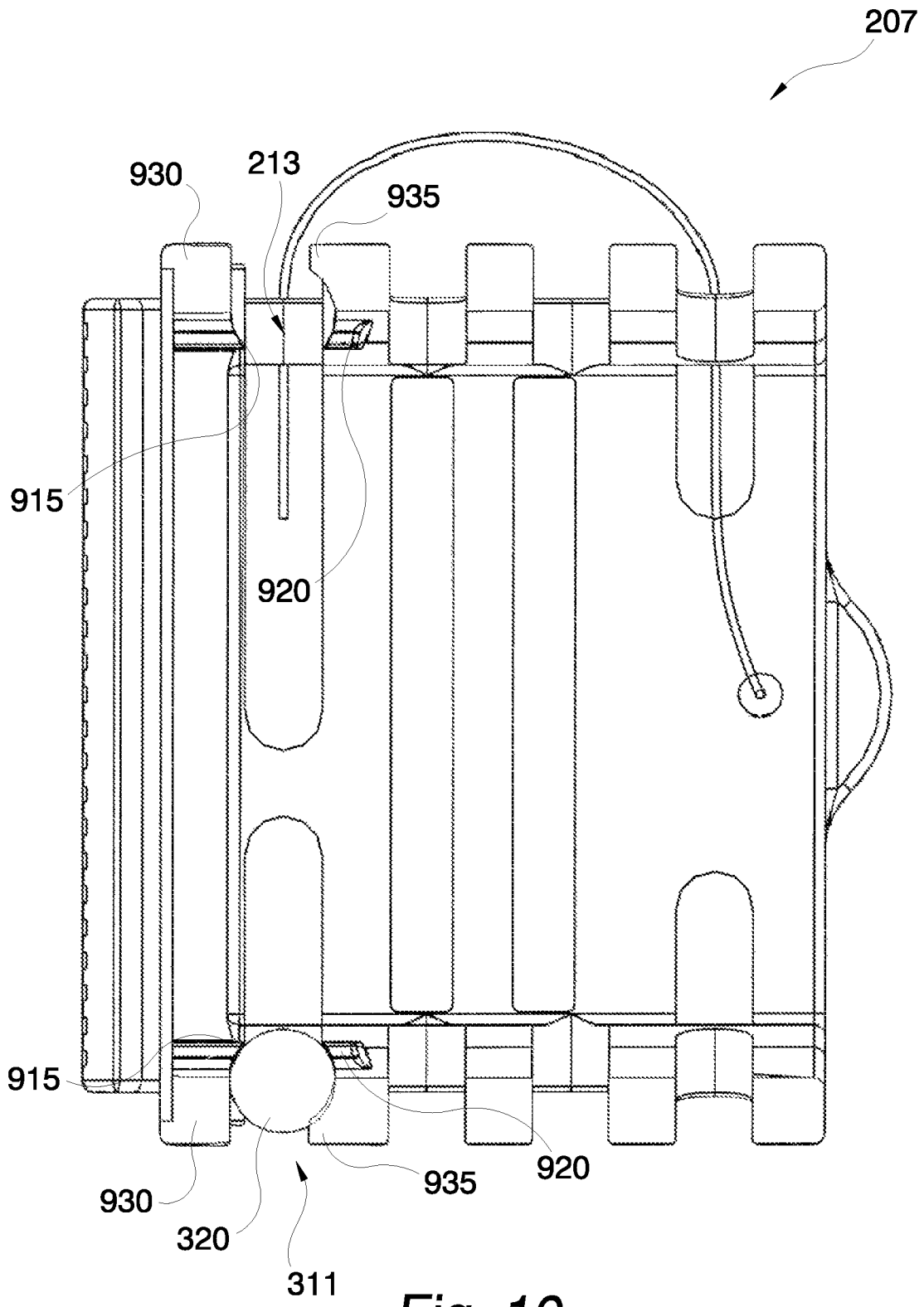
FIG. 10 is a cross-sectional view of the sight hood of FIG. 9.
Figure 11:
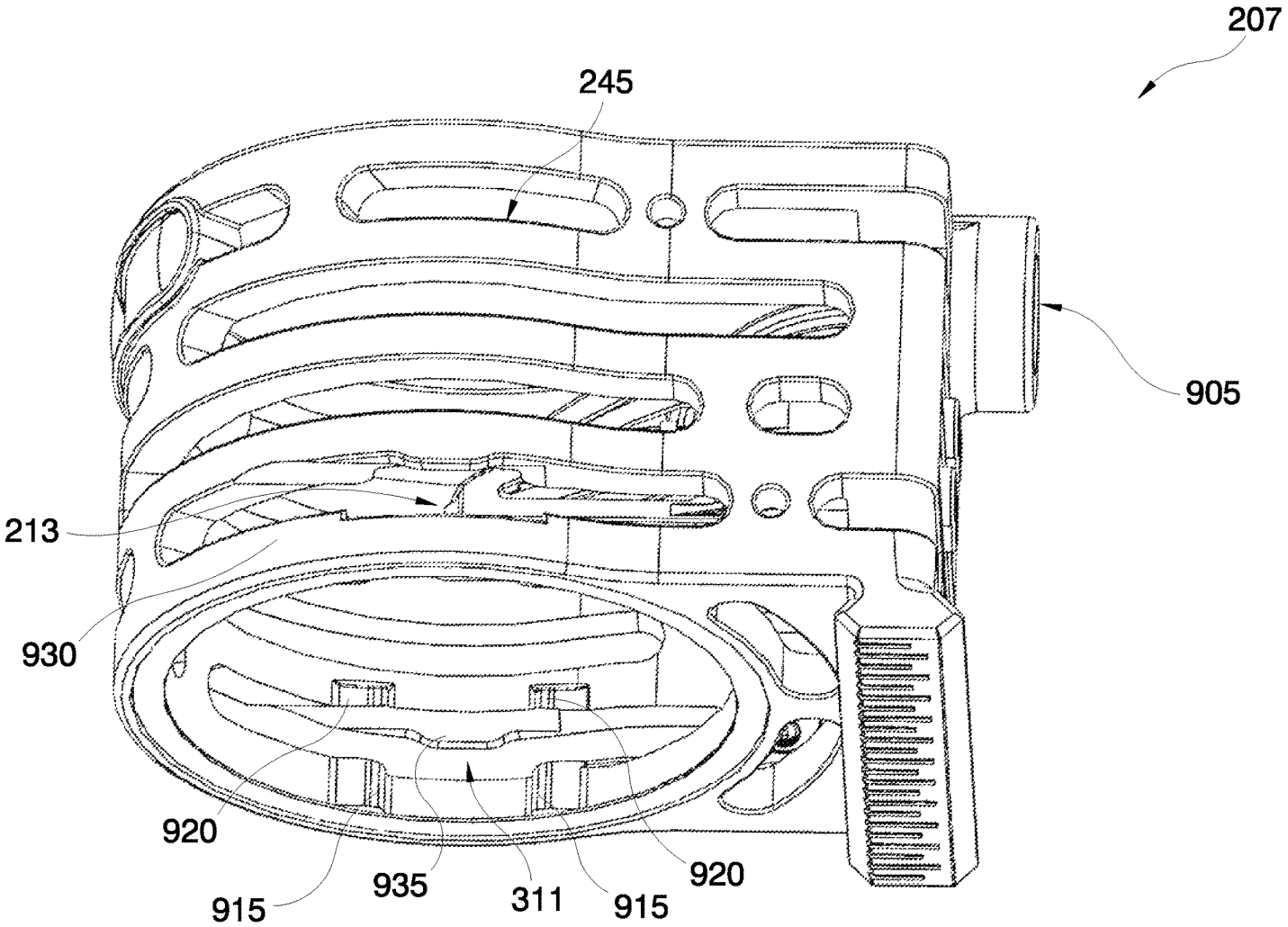
FIG. 11 is a perspective view of the sight hood of FIG. 9 without a sight level.
Figure 12:
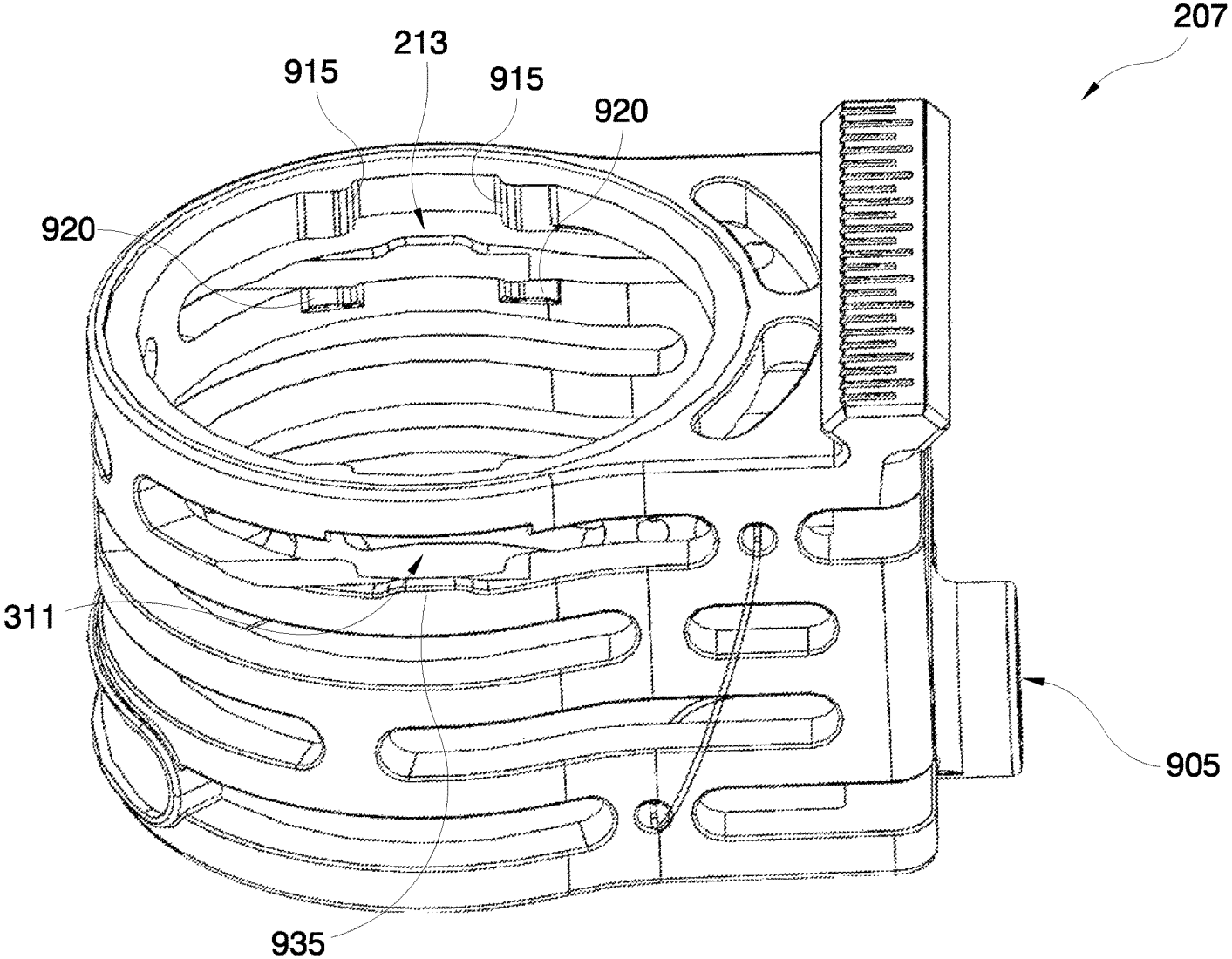
FIG. 12 is another perspective view of the sight hood of FIG. 9 without the sight level.

FIGS. 7 and 8 show examples of the archery sight 100 in a left-hand configuration 700. In the left-hand configuration 700, the sight level 320 is generally held in a second aperture 213. The second aperture 213 is the same as the first aperture 311 described above. For example, the second aperture 213 and the first aperture 311 share all of the same components. The second aperture 213 is defined by the body 209 and is generally positioned along a bottom edge of the sight hood 207 when in the right-hand configuration 500. When in the left-hand configuration 700, the first aperture 311 is generally positioned along a top edge of the sight hood 207. When in the right-hand configuration 500, the orientations of the second aperture 213 and the first aperture 311 are reversed, such that the second aperture 213 is along a top edge of the sight hood 207 and the first aperture 311 is along a bottom edge of the sight hood 207. Optionally, an archer may decide to mount the sight level 320 in the first aperture 311, at an upper edge of the sight hood 207, when in the left-hand configuration based on personal preference.

While the disclosure has been illustrated and described in detail in the drawings and foregoing description, the same is to be considered as illustrative and not restrictive in character, it being understood that only the preferred embodiment has been shown and described and that all changes and modifications that come within the spirit of the disclosure are desired to be protected.

What is claimed is:

1. A sight for an archery bow, comprising:

a mounting bracket configured to mount to an archery bow;

a sight hood removably mounted to the mounting bracket, wherein the sight hood defines at least one aperture; and a sight level mounted within the sight hood in the at least one aperture;

wherein the sight level is selectively retained within the at least one aperture via a snap-fit connection between the sight level and the aperture.

2. The sight of claim 1, wherein the at least one aperture includes a first aperture located along a bottom edge of the sight hood in a right-hand configuration.

3. The sight of claim 2, wherein the at least one aperture includes a second aperture located along an upper edge of the sight hood in the right-hand configuration.

4. The sight of claim 3, wherein 180-degree rotation of the sight transforms the sight from the right-hand configuration to a left-hand configuration.

5. The sight of claim 1, comprising a pair of first prongs and a pair of second prongs adjacent the ends of the at least one aperture, and wherein the snap-fit connection includes the first prongs and the second prongs retaining the sight level.

6. The sight of claim 5, wherein the first prongs and the second prongs define a mouth of the aperture, and wherein the mouth of the aperture is smaller than a diameter of the sight level.

7. The sight of claim 5, wherein the sight level is retained within the apertures by a tongue extending from the sight hood.

8. A sight for an archery bow, comprising:

a mounting bracket configured to mount to an archery bow;

a sight hood removably mounted to the mounting bracket, wherein the sight hood defines a pair of opposing apertures; and a sight level;

wherein the sight level is selectively positionable in either of the pair of apertures, and wherein the sight level is removably held within the selected aperture via a snap-fit connection between the sight level and the selected aperture.

9. The sight of claim 8, wherein 180-degree rotation of the sight transforms the sight from a right-hand configuration to a left-hand configuration.

10. The sight of claim 9, wherein the first aperture is located along a bottom edge of the sight hood in the right-hand configuration, and wherein the second aperture is located along the bottom edge of the sight hood in the left-hand configuration.

11. The sight of claim 10, wherein the sight level is retained within the first aperture in the right-hand configuration, and wherein the sight level is retained within the second aperture in the left-hand configuration.

12. The sight of claim 10, comprising a pair of first prongs and a pair of second prongs arranged adjacent opposing ends of each aperture, and wherein the snap-fit connection includes the first prongs and the second prongs retaining the sight level.

13. The sight of claim 12, wherein the first prongs and the second prongs further define a mouth of the aperture, and wherein the mouth of the aperture is smaller than a diameter of the sight level.

14. The sight of claim 12, wherein the sight level is retained within the apertures by a tongue extending from the ribs of the sight hood.

15. A sight for an archery bow, comprising:

a mounting bracket configured to mount to an archery bow;

a sight hood removably mounted to the mounting bracket, wherein the sight hood defines a pair of oppositely opposing apertures; and a sight level;

wherein the sight is configured for a right-hand configuration or a left-hand configuration by orienting the sight hood in a desired orientation and placing the sight level in the aperture oriented along a lower edge of the sight hood in the desired orientation; and wherein the sight level is selectively held within the aperture via a snap-fit connection between the sight level and the aperture.

16. The sight of claim 15, wherein the first aperture is located along a bottom edge of the sight hood in the right-hand configuration, and wherein the second aperture is located along the bottom edge of the sight hood in the left-hand configuration.

17. The sight of claim 15, comprising a pair of first prongs and a pair of second prongs adjacent opposing ends of each aperture, and wherein the snap-fit connection includes the first prongs and the second prongs retaining the sight level in an aperture.

* * * * *